US005782977A

United States Patent [19]

Eriksson et al.

[11] Patent Number: 5,782,977

[45] Date of Patent: Jul. 21, 1998

[54] BLADE COATING MACHINE HAVING SIDE EDGE LUBRICATION AND PROCESS OF COATING

[75] Inventors: Tore Eriksson, Klässbol; Håkan Karlsson, Säffle, both of Sweden

[73] Assignee: BTG Källe Inventing AB, Säffle, Sweden

[21] Appl. No.: 663,195

[22] PCT Filed: Dec. 14, 1994

[86] PCT No.: PCT/SE94/01206

§ 371 Date: Jun. 11, 1996

§ 102(e) Date: Jun. 11, 1996

[87] PCT Pub. No.: WO95/17264

PCT Pub. Date: Jun. 29, 1995

[30] Foreign Application Priority Data

Dec. 22, 1993 [SE] Sweden ..... 9304255

[51] Int. Cl.[6] ..... B05C 11/02

[52] U.S. Cl. ..... 118/119; 118/126; 427/285; 427/286; 427/356; 427/359; 427/361

[58] Field of Search ..... 427/356, 285, 427/286, 359, 361; 118/119, 126

[56] References Cited

U.S. PATENT DOCUMENTS 4,292,349 9/1981 Ishiwata et al. ..... 427/335

4,738,877 4/1988 Krautzberger .

4,976,992 12/1990 Chino et al. ..... 427/284

5,112,653 5/1992 Damrau et al. ..... 427/356

FOREIGN PATENT DOCUMENTS 0 460 777 12/1991 European Pat. Off. .

*Primary Examiner*—Katherine A. Bareford

*Attorney, Agent, or Firm*—Burns, Doane, Swecker & Mathis, L.L.P.

[57] ABSTRACT

A device for the coating of a travelling web (7), preferably a paper web, comprising a back-up element (3), a metering means (9) cooperating therewith and intended for the application onto the web (7) across essentially the full width thereof a coating liquid (13), a coating blade (17) positioned downstream of the metering means (9), and means for feeding the web (9) in the nip between the back-up element (3) and the metering means (9) and between the back-up element (3) and the coating blade (17). The device further comprises at least one edge lubricating means (27) which is positioned adjacent to one edge (43) of the web and upstream of the metering means (9), and which is arranged to deposit along said one edge (43) a string of lubricating liquid at least up to a position cross-wise and inwardly of the web adjacent to the margin of the coating liquid (13) when applied, whereby uneven wear of the coating blade (17) is avoided; and a process for the coating of a travelling web.

16 Claims, 2 Drawing Sheets

BLADE COATING MACHINE HAVING SIDE EDGE LUBRICATION AND PROCESS OF COATING

TECHNICAL FIELD

The present invention relates to a device for the coating of a travelling web, preferably a paper web. The invention also embraces a process for such coating.

BACKGROUND OF THE INVENTION

By blade coating there is meant a coating process, wherein a web engaging a back-up member, for example a roll, in a first step is supplied with a coating liquid in excess. In the next stage removal of the excess of coating liquid and evening of the coating layer by using a so called coating blade take place.

In the coating of a paper web in accordance with conventional techniques the coating does not take place all the way up to the side edges of the web but sections having a width of about 10 mm are left uncoated along the two web edges. The reason for this is that if coating is performed all the way out to the side edges all the side surface of the edge which is more or less uneven will be coated. In view of this uneven side surface coating liquid is entrained in a larger amount than compared to the quantity on the normal coating surface of the paper. The coating liquid applied to the side surface also partly migrates to the other side of the web, and since this side during the transport of the web through the coating machine is in contact with rolls coating liquid will be deposited on said rolls thereby creating operational problems. The manner of avoiding coating of the web all the way out to the side edges thereof thus constitutes a solution to said problem.

However, the conventional techniques described above are associated with an important disadvantage residing in the fact that the coating blade is more rapidly worn out at the edge sections where no coating liquid is applied. Therefore, the coating blade must be replaced before it has been worn out on the section thereof where coating liquid is applied. Frequent blade replacements are expensive, on the one hand by the cost of the blade itself, on the other hand by the interruption of the production caused by the exchange.

The present invention has for an object to seek elimination of the edge wear problem in all blade coating where there is used the techniques of uncoated edge sections.

Another object of the present invention is to provide techniques, whereby the outer extension line for applied coating liquid becomes substantially rectilinear.

For these and other objects which will be clear from the following description there is provided through the present invention a device for the coating of a travelling web, preferably a paper web, comprising a back-up element, a metering means cooperating therewith and intended for the application onto the web across essentially the full width thereof of a coating liquid, a coating blade positioned downstreams of the metering means, and means for feeding the web in the nip between the back-up element and the metering means and between the back-up element and the coating blade. The device according to the invention comprises at least one edge lubricating means which is positioned adjacent to one edge of the web and upstream of the metering means and which is arranged to deposit along said one edge a string of lubricating liquid at least up to a position cross-wise and inwardly of the web adjacent to the margin of the coating liquid then applied. By this lubrication of the edge of the web there is avoided a much too early wear of the coating blade in the area immediately outside of the applied coating liquid.

In a preferred embodiment of the device according to the invention the edge lubrication means is positioned in the cross-wise direction in relation to the outer extreme of the metering means in such a manner that overlap between the coating liquid and the lubricating liquid will be obtained. In this manner there is obtained by the coating blade removal of the overlapping section of the coating liquid so that a rectilinear limit line for the coating liquid will be obtained.

It is particularly preferred to arrange an edge lubricating means at each edge of the web. It is also preferred that the back-up element or metering means or both are constituted by rotary rolls.

In a preferred embodiment of the device according to the invention the edge lubrication means includes a mounting member, a pivot arm carried at one end thereof and an application head carried at the opposite end of the pivot arm for deposition of said string of lubricating liquid.

Said metering means is suitably constituted by at least one metering rod, and it is particularly preferred that the metering means is constituted by a forward metering rod and a rear metering rod.

The present invention also relates to a process for the coating of a travelling web, preferably a paper web, which process comprises application of coating liquid onto the web substantially across the full width thereof and evening of applied coating liquid, and the process is characterized by applying a string of lubricating liquid upstream of the application site for the coating liquid at at least one side edge of the web, which string crosswise extends at least up to a position adjacent to the side margin of the coating liquid then applied.

It is preferred that a string of lubricating liquid is applied along each side edge of the web. Furthermore, it is suitable that the coating liquid is applied to overlap with the applied lubricating liquid, whereby in the subsequent evening of the applied coating liquid the overlapping part thereof will be removed to form a rectilinear limit line with regard to the coating liquid.

In the present disclosure the expression "liquid", both with regard to the coating liquid and the lubricating liquid, does not per definition relate to only true liquids but also such agents that may be present in a viscuous or a semi-solid form, for example as a paste.

BRIEF DESCRIPTION OF THE DRAWINGS

The invention will in the following be described further by a preferred embodiment exemplifying the invention, and this description is carried out in association with the appended drawing, wherein.

DESCRIPTION OF THE PREFERRED EMBODIMENTS

Figure 1:
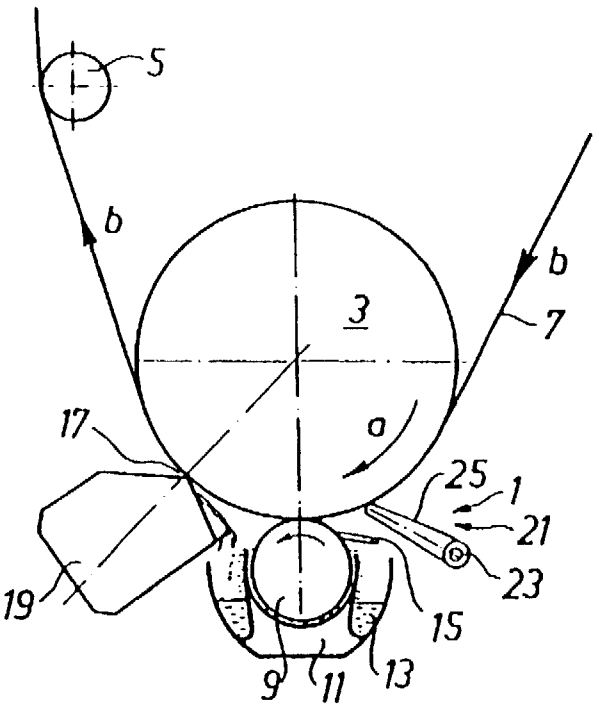
FIG. 1 shows a diagrammatic side view of a device according to the present invention.

The coating machine shown in FIG. 1 in a diagrammatic side view and generally designated 1 comprises a back-up roll 3 rotated in the directing of arrow a, a metering roll 9 having a corresponding direction of rotation and a paper guide roll 5. A paper web 7 is fed in the direction of arrows b in the nip between the back-up roll 3 and the metering roll 9. The metering roll 9 applies coating liquid 13 onto paper web 7 from a trough 11.

Downstream of the metering roll 9 a coating blade 17 is arranged which, in a conventional manner, is attached in a blade holder 19. The coating blade 17 extends across the web over the whole width thereof.

An edge lubricating means generally designated 21 is placed upstream of the metering roll 9 and includes a mounting member 23 shown diagrammatically, a pivot arm pivotably arranged at one end of mounting means 23 and an application head arranged at the other end of pivot arm 25.

Figure 2:
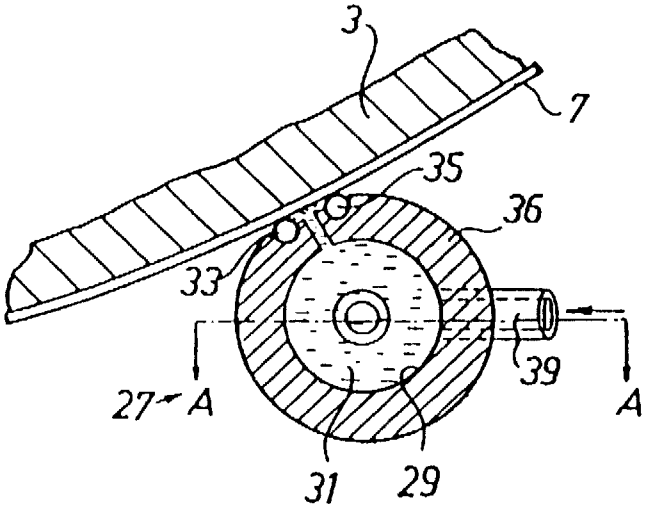
FIG. 2 shows, also diagrammatically, a side view of a detail of the device in FIG. 1 in enlargement.
Figure 3:
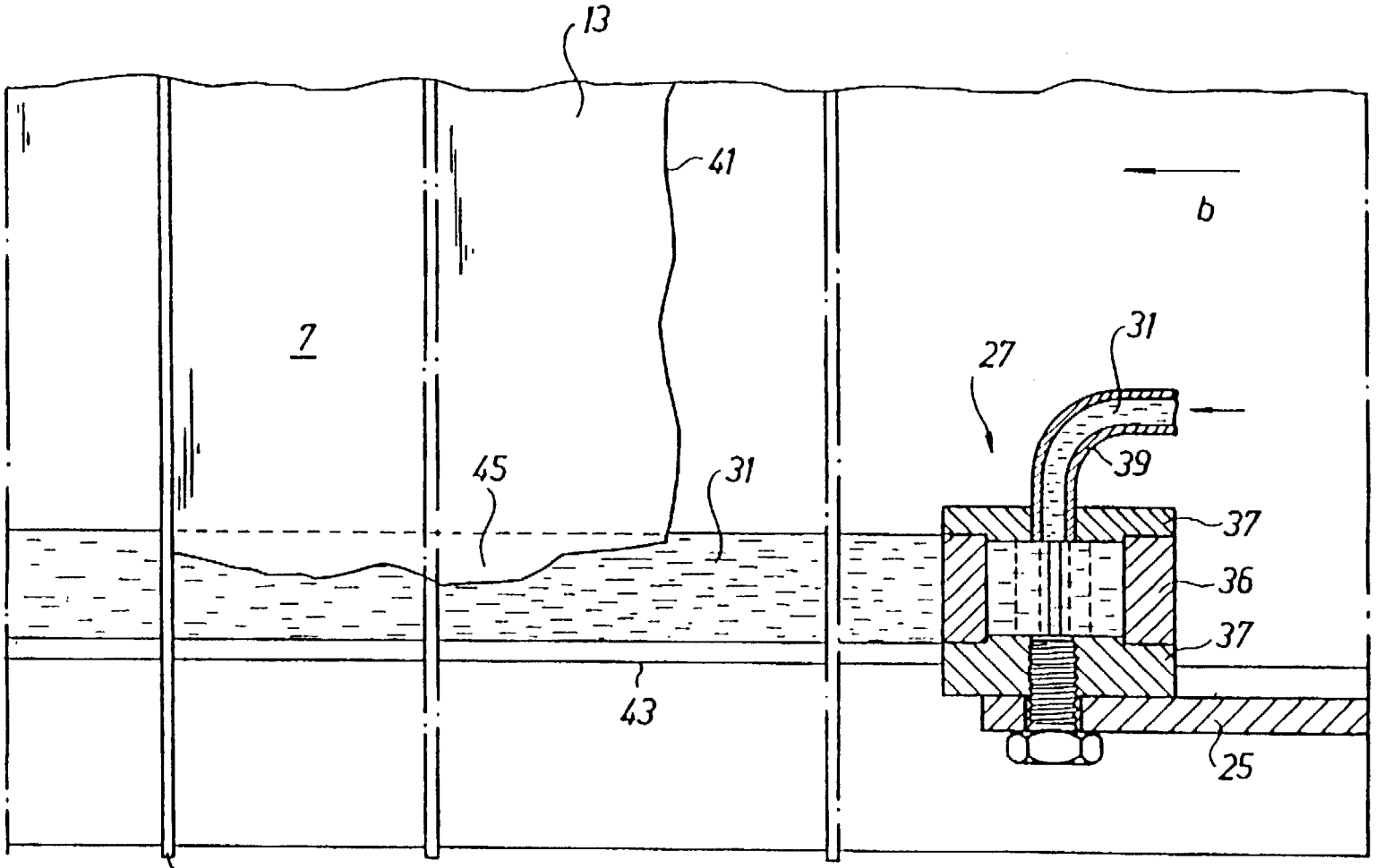
FIG. 3 is a plan view of the side section of a travelling web showing an edge lubricating means designed in accordance with the invention.

The application head 27 is shown more in detail in enlargement in FIGS. 2 and 3. A chamber 29 for lubricating liquid 31 is defined by a tube element 36 and end walls 37. Chamber 29 is provided with a supply tube 39 for the introduction of lubricating liquid into the chamber. This supply takes place by means of continuous dosage with the introduction of a controlled amount, for example by means of a membrane pump or other suitable metering pump. This will regulate the quantity per surface unit of lubricating liquid supply to the paper web. Chamber 29 is confined at the site of engagement against the back-up roll 3 of a forward dosage rod 33 and a rear sealing rod 35. These two rods are held in their respective recesses and slide against the paper web.

The application head can be pivoted away by means of pivot arm 25 from the engagement against the back-up roll 3 and maintained in operative position in engagement against paper web 7 and the back-up roll 3 by means not shown, for example pneumatically, using a spring or a weight.

In connection with the dosage roll 9 edge doctoring elements 15 are arranged to restrict the extension side wise of the coating liquid.

In FIG. 3 there is shown a plan view with the application head 27 shown in a section along line A—A in FIG. 2. From this plan view it is clear the extension side wise of on the one hand the string of lubricating liquid 31, on the other hand the area for extension of the coating liquid 13. One side edge of the paper web 7 is shown at 43.

The function of the blade coating apparatus 1 described briefly above is mainly the following.

Paper web 7 is fed in the direction of arrows b, and at the application head 27 the paper web at one side edge 43 thereof is supplied with a string of lubricating liquid 31. The dosage roll 9 then applies coating liquid 13 to web 7, the limit line of the coating liquid being shown at 41. As is clear from FIG. 3 the coating liquid 13 is deposited so as to give a certain overlap with the lubricating liquid 31. This overlapping area is shown at 45. When the web having coating liquid 13 and lubricating liquid 31 applied thereto travels up to the coating blade 17 doctoring of the excess of coating liquid 13 takes place, the limit line for the coating liquid 13 being rectilinear, as is clear to the left in FIG. 3.

The function of the lubricating liquid 31 is thus to lift the coating blade 17 so that it "floats" on a non-corrosive liquid film, as is the case where coating liquid has been deposited, instead of engaging the dry paper as in the conventional techniques hitherto used. The lubricating liquid may consist of water and a substance dissolved therein not affecting the ordinary coating liquid in admixture therewith, such as carboximethyl cellulose or starch. Already at a concentration of about 1% such polysaccharides result in a sufficient viscosity to form a lubricating film. However, the invention is not restricted to the use of such lubricating liquids since other variants are conceivable. At the low concentration which is possible there is no build-up on the rolls coming into contact with the lubricating liquid. Furthermore, the quantity of lubricating agent removed by the coating blade must not spread out the ordinary coating liquid in an uncontrolled manner in view of which it is desirable that the amount of lubricating agent applied onto the web is controlled both with regard to location and quantity. The device described above meters an adopted quantity of lubricating liquid onto the paper web upstream of the dosage roll for a coating liquid.

EXAMPLE

The following table shows examples of values from tests using the device and the process according to the invention:

TABLE

| | |
|---|---|
| Lubricating liquid | CMC conc. 1.5% by weight in solution, viscosity 1900 cps |
| String width | 2 cm |
| Machine speed | 350 m/min |
| Supplied quantity | 18 g/m$^2$ |
| Pumped flow | 0.13 L/min |

In the above experiment where one edge section was treated in a conventional manner and the other was treated using the device and the process according to the invention a significant reduction of blade wear could be observed after 6 h of operation. On the section treated in accordance with conventional techniques the wear was so extended as to require a blade replacement. The edge section treated according to the invention did not- show any wear of practical importance. The life period of the coating blade could, according to estimation, have been increased up to 18–24 h provided both edge sections had been treated in accordance with the invention.

The edge section of the paper treated according to the invention displayed a completely rectilinear edge, whereas the conventionally treated edge varied in rectilinearity± about 5 mm.

The advantages gained by the techniques according to the present invention are important and are mainly constituted on the one hand by even wear of the coating blade, on the other hand the provision of a rectilinear limit line for the coating liquid according to the side edges. The first feature results in substantially reduced wear of the coating blade and thereby longer periods of operation between the blade exchanges, and the other feature results in less paper waste in edge trimming and better control of the distribution of the coating liquid.

We claim:

1. A device for coating a travelling paper web, comprising a back-up element, a metering means cooperating with said back-up element for applying onto the web across essentially a full width thereof a coating liquid, a coating blade positioned downstream of the metering means and extending across essentially the full width of said web, and means for feeding the web to a nip between the back-up element and the metering means and to a nip between the back-up element and the coating blade, at least one edge lubricating means positioned adjacent to one edge of the web and upstream of the metering means and which is arranged to deposit along said one edge a stripe of lubricating liquid at least up to a position cross-wise and inwardly of the web adjacent to a margin of the coating liquid when applied, wherein said coating blade extends across said stripe of lubricating liquid and the coating liquid when applied to the web such that during evening of said coating liquid uneven wear of the coating blade is avoided;

wherein the edge lubricating means includes a mounting member, a pivot arm carried at one end of said mounting member and an application head carried at the opposite end of the pivot arm for deposition of said stripe of lubricating liquid.

2. A device according to claim 1, wherein the edge lubricating means is positioned in a cross-wise direction in relation to an outer extreme of the metering means in such a manner that overlap between the coating liquid and the lubricating liquid if obtained, whereby the coating blade removes the overlapping section of the coating liquid to form a rectilinear limit line for the coating liquid.

3. A device according to claim 2, wherein an edge lubricating means positioned at each edge of the web.

4. A device according to claim 2, wherein the back-up element and/or the metering means are constituted by rotary rolls.

5. A device according to claim 2, wherein the edge lubricating means includes a mounting member, a pivot arm carried at one end of said mounting member and an application head carried at the opposite end of the pivot arm for deposition of said stripe of lubricating liquid.

6. A device according to claim 1, further comprising an edge lubricating means positioned at each edge of the web.

7. A device according to claim 6, wherein the back-up element and/or the metering means are constituted by rotary rolls.

8. A device according to claim 1, wherein the back-up element and/or the metering means are constituted by rotary rolls.

9. A device according to claim 1, wherein the application head includes a container and a supply tube for lubricating liquid and a metering element engaging the web for the deposition of said stripe onto the web.

10. A device according to claim 9, wherein said metering element is constituted by at least one metering rod.

11. A device according to claim 10, wherein the application head comprises a front metering rod and a rear sealing rod.

12. A device according to claim 11, further comprising a metering pump by means of which the amount of lubricating liquid applied per unit of surface onto the web is controlled.

13. A device according to claim 10, further comprising a metering pump by means of which the amount of lubricating liquid applied per unit of surface onto the web is controlled.

14. A device according to claim 9, further comprising a metering pump by means of which the amount of lubricating liquid applied per unit of surface onto the web is controlled.

15. A device according to claim 1, further comprising a metering pump by means of which the amount of lubricating liquid applied per unit of surface onto the web is controlled.

16. A device according to claim 1, wherein said travelling web comprises a paper web.

* * * * *